United States Patent [19]

Mode et al.

[11] Patent Number: 4,989,734

[45] Date of Patent: Feb. 5, 1991

[54] ORDER FILLER AND SUPPLY CONTAINER APPARATUS

[76] Inventors: Ronald L. Mode, 1713 S. 11th St., Blue Springs, Mo. 64015; Earl W. Lacey, 6125 N. Wheeling, Kansas City, Mo. 64119; Jack R. Shilt, 8740 N.W. Boone, Kansas City, Mo. 64155

[21] Appl. No.: 529,540

[22] Filed: May 29, 1990

[51] Int. Cl.[5] ..... B65D 85/671

[52] U.S. Cl. ..... 206/575; 206/225; 206/389; 206/391; 206/818; 206/373

[58] Field of Search ..... 206/575, 572, 582, 225, 206/229, 230, 231, 389, 391, 818, 224, 371, 372, 373, 562, 563; 220/23-83

[56] References Cited

U.S. PATENT DOCUMENTS

| | | | |
|---|---|---|---|
| 2,710,151 | 6/1955 | Delaney | 206/391 X |
| 3,481,452 | 12/1969 | Pichios | 206/225 X |
| 3,820,656 | 6/1974 | Orr | 206/389 X |
| 4,186,833 | 2/1980 | Homan | 206/225 |
| 4,512,503 | 4/1985 | Gioso | 206/371 X |
| 4,759,441 | 7/1988 | Leurck | 206/818 X |
| 4,874,119 | 10/1989 | Winter | 206/373 X |

FOREIGN PATENT DOCUMENTS

| | | | |
|---|---|---|---|
| 2460643 | 3/1981 | France | 206/818 |

*Primary Examiner*—Paul T. Sewell
*Assistant Examiner*—Jacob K. Ackun, Jr.
*Attorney, Agent, or Firm*—Leon Gilden

[57] ABSTRACT

An apparatus including a container formed with a recessed forward wall providing access to a central compartment containing a plurality of shrink-wrap foil roll members for wrapping of various packages, wherein the container includes spaced side walls, wherein a first side wall includes a first hopper for securement of note pads therewithin, wherein a second hopper mounted on a further side wall includes felt marker pens and a plurality of pens and pencils, with an underlying third hopper including wrapper tape and cutter members mounted therewithin. A fourth hopper includes a compartment for accommodation of debris and discarded paper and the like therewithin. The container includes a magnetic or alternatively a hook and loop fastener base for securement to various underlying supports.

6 Claims, 5 Drawing Sheets

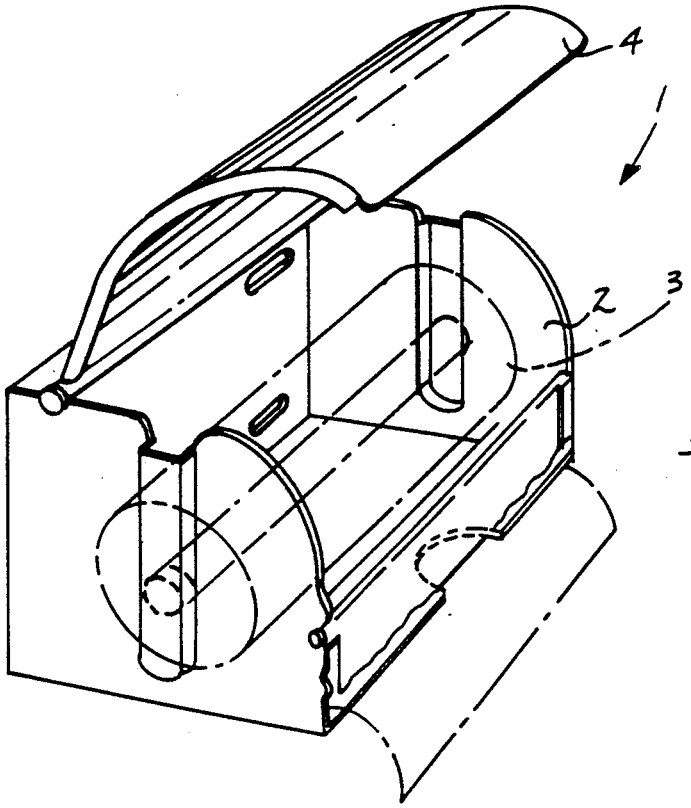
Fig 1
PRIOR ART
Fig 2
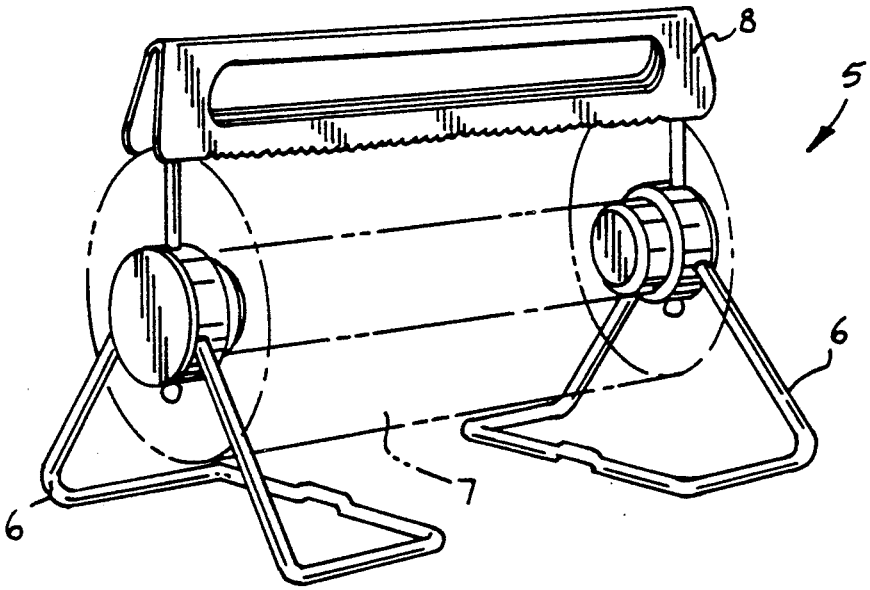
PRIOR ART

ORDER FILLER AND SUPPLY CONTAINER APPARATUS

BACKGROUND OF THE INVENTION

1. Field of the Invention

The field of invention relates to dispenser apparatus, and more particular pertains to a new and improved order fill and upper container apparatus wherein the same provides an assemblage in kit form of various components required in the processing of packages for distribution to individuals.

2. Description of the Prior Art

Various wrapping container dispensers have been utilized throughout the prior art to accommodate the wrapping of articles for subsequent conveyance and delivery to individuals. The instant invention sets forth an organization wherein an operative organization of components permits wrapping and securement of the wrap to various articles, as well as the writing instruments required for indication of various indicia and the like upon such articles thusly wrapped. Examples of prior art devices include U.S. Pat. No. 4,324,345 to Martinez setting forth a dispenser for the distribution of sheet portions of material from a storage container within the dispenser.

U.S. Pat. No. 1,609,862 to Clifford sets forth a paper dispensing device distributing portions of sheet material from a roll confined within the container of the dispensing device.

U.S. Pat. No. 2,592,571 to Huntington sets forth a roll material dispenser providing an axle upon which a roll of material may be secured.

U.S. Pat. No. 2,304,312 to Meglitz provides a housing containing a roll of wrapping material for dispensing of the material through a slot formed within the container of the organization.

U.S. Pat. No. 301,667 to Barrs, et al. sets forth spaced brackets to support a roll of material therebetween, with an overlying cutter for severing and distribution of sheet material contained within the organization.

As such, it may be appreciated there continues to be a need for a new and improved order fill and supply container apparatus wherein the same addresses both the problems of ease of use, as well as effectiveness in the complete housing of various components utilized in the wrapping and distribution of packaging material.

SUMMARY OF THE INVENTION

In view of the foregoing disadvantages inherent in the known types of dispensing containers now present in the prior art, the present invention provides an order fill and supply container apparatus wherein the same includes a plurality of rolls of wrapping paper and associated marking instruments to accommodate various requirements of wrapping articles, and wherein the apparatus is conveniently and readily securable to a support member. As such, the general purpose of the present invention, which will be described subsequently in greater detail, is to provide a new and improved order fill and supply container apparatus which has all the advantages of the prior art dispensing containers and none of the disadvantages.

To attain this, the present invention provides an apparatus including a container formed with a recessed forward wall providing access to a central compartment containing a plurality of shrink-wrap foil roll members for wrapping of various packages, wherein the container includes spaced side walls, wherein a first side wall includes a first hopper for securement of note pads therewithin, wherein a second hopper mounted on a further side wall includes felt marker pens and a plurality of pens and pencils, with an underlying third hopper including wrapper tape and cutter members mounted therewithin. A fourth hopper includes a compartment for accommodation of debris and discarded paper and the like therewithin. The container includes a magnetic or alternatively a hook and loop fastener base for securement to various underlying supports.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciates that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved order fill and supply container apparatus which has all the advantages of the prior art dispensing containers and none of the disadvantages.

It is another object of the present invention to provide a new and improved order fill and supply container apparatus which may be easily and efficiently manufactured and marketed.

It is a further object of the present invention to provide a new and improved order fill and supply container apparatus which is of a durable and reliable construction.

An even further object of the present invention is to provide a new and improved order fill and supply container apparatus which is susceptible of a low cost of manufacture with regard to both materials and labor, and which accordingly is then susceptible of low prices of sale to the consuming public, thereby making such order fill and supply container apparatus economically available to the buying public.

Still yet another object of the present invention is to provide a new and improved order fill and supply container apparatus which provides in the apparatuses and methods of the prior art some of the advantages thereof, while simultaneously overcoming some of the disadvantages normally associated therewith.

Still another object of the present invention is to provide a new and improved order fill and supply container apparatus wherein the same arranges and orients various components in a package wrapping scenario to permit convenience of access and availability of various components.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a prior art sheet dispensing device.

FIG. 2 is an isometric illustration of a further prior art sheet dispensing device.

DESCRIPTION OF THE PREFERRED EMBODIMENT

Figure 3:
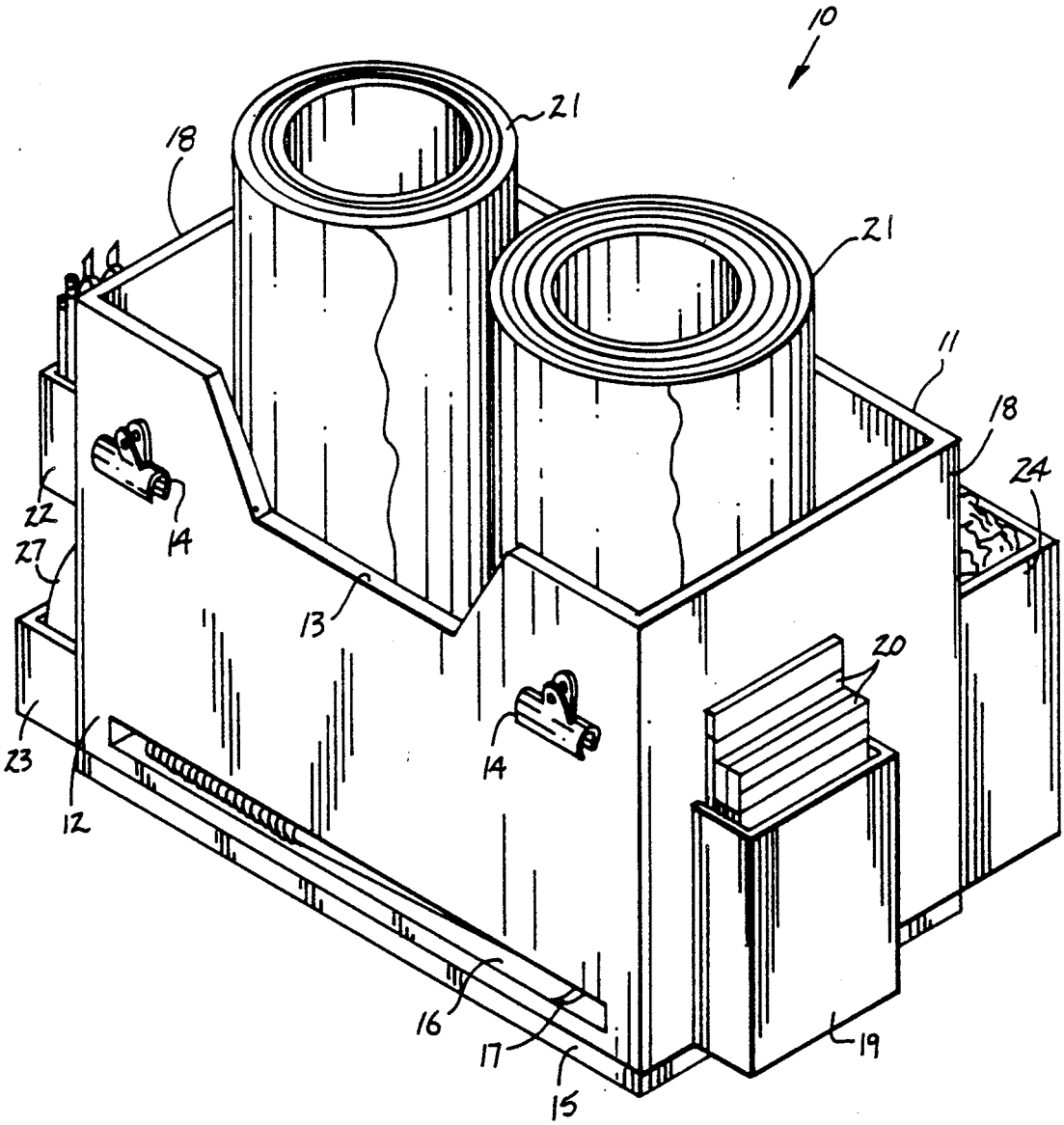
FIG. 3 is an isometric illustration of the instant invention.
Figure 4:
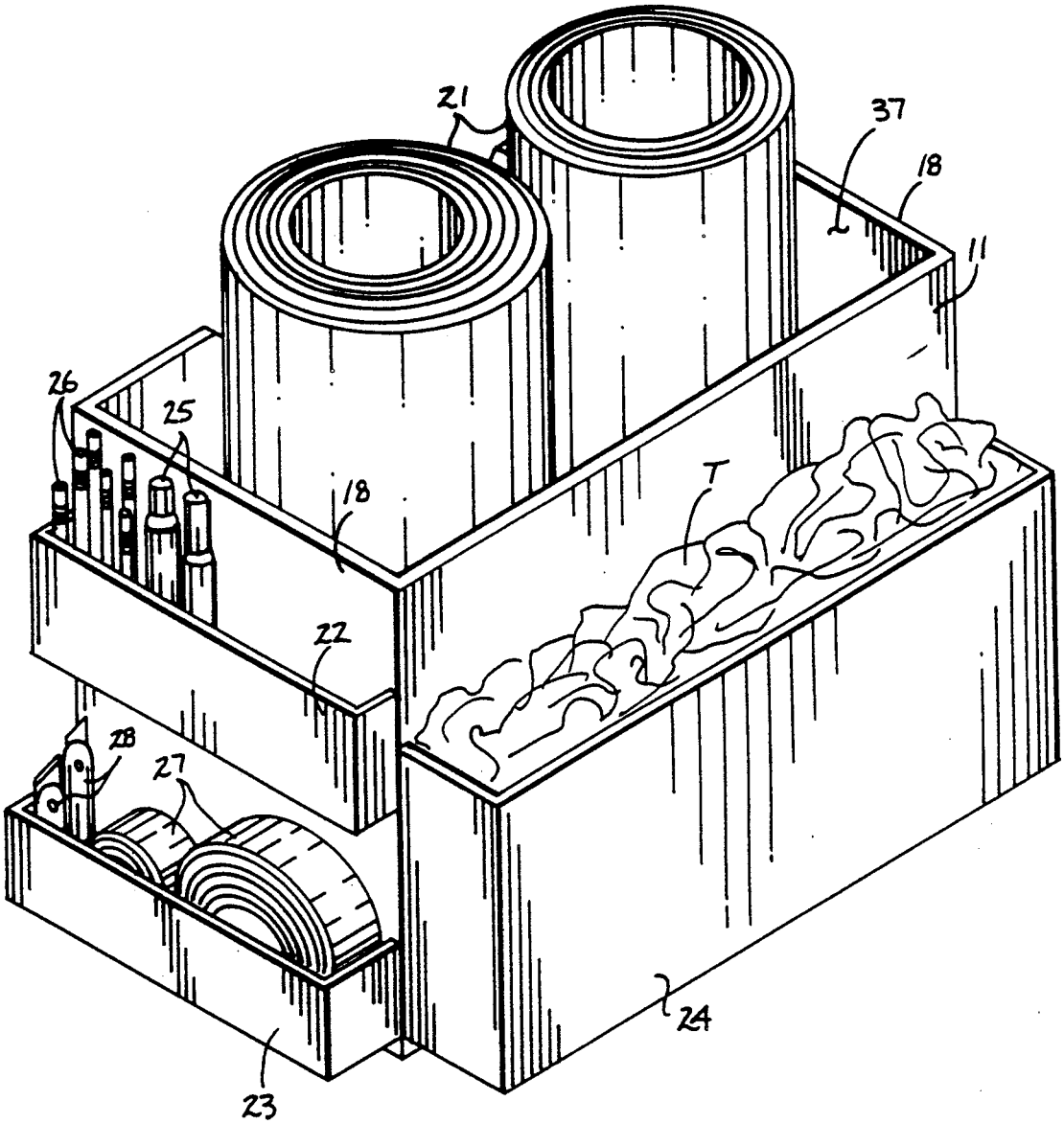
FIG. 4 is a rear isometric illustration of the instant invention.

With reference now to the drawings, and in particular to FIGS. 1 to 8 thereof, a new and improved order fill and supply container apparatus embodying the principles and concepts of the present invention and generally designated by the reference numeral 10 will be described.

FIG. 1 illustrates a prior art sheet dispensing device 1, including a housing 2 rotatably mounting a wound sheet roll 3, including an overlying lid 4. FIG. 2 illustrates a further sheet dispensing device 5, including spaced support brackets 6 rotatably mounting a roll of sheet material 7 therebetween utilizing an overlying serrated member 8.

More specifically, the order fill and supply container apparatus 10 of the instant invention essentially comprises an organization to effect a convenient and orderly presentation of various components required by individuals in the wrapping and logging of various orders typically within a warehousing arrangement. The apparatus includes a housing defined by a container, including a rear wall 11, a parallel forward wall 12, and spaced side walls 18. The forward wall 12 includes a "U" shaped recess positioned medially to a top edge of the forward wall to provide access to components contained within the container, such as the shrink-wrap foil cylinders formed of a continuous sheet of a shrink-wrap type material or other suitable wrapping material. The forward wall 12 includes a plurality of spaced spring clips 14 mounted on the forward wall to secure various notes and addendum thereto. The housing defining the container includes a magnetic base 15. The magnetic base permits selective securement to various metallic support structures or alternatively, a hook and loop fastener base may be utilized should support upon a fabric member be required. Positioned longitudinally of the foward wall 12 adjacent the magnetic base 15 is an elongate slot recess 16, including a removable hook member 17 mounted and stored therewithin for providing access to various components of the organization whose positioning requires a grappling type member, such as the hook member 17. A side wall 18 of the container includes a first hopper 19, including a plurality of note pads and forms 20 therewithin. A second hopper 20 mounted upon an oposing side wall includes a plurality of felt marker pens 25 and a plurality of pens and pencils 26 contained therewithin. A third hopper 23 positioned coextensively with the side wall underlying the second hopper includes wrapping tape and cutter members 28 contained therewithin. The cutter members, as well as the tape, are removable relative to the third hopper 23 for use. A fourth hopper 24 mounted upon the rear wall 11 is arranged for receiving debris or other such discarded trash "T" within the fourth hopper and is of a configuration to accommodate a quantity of such material and is accordingly generally coextensive with the predetermined length of the rear wall 11.

Figure 5:
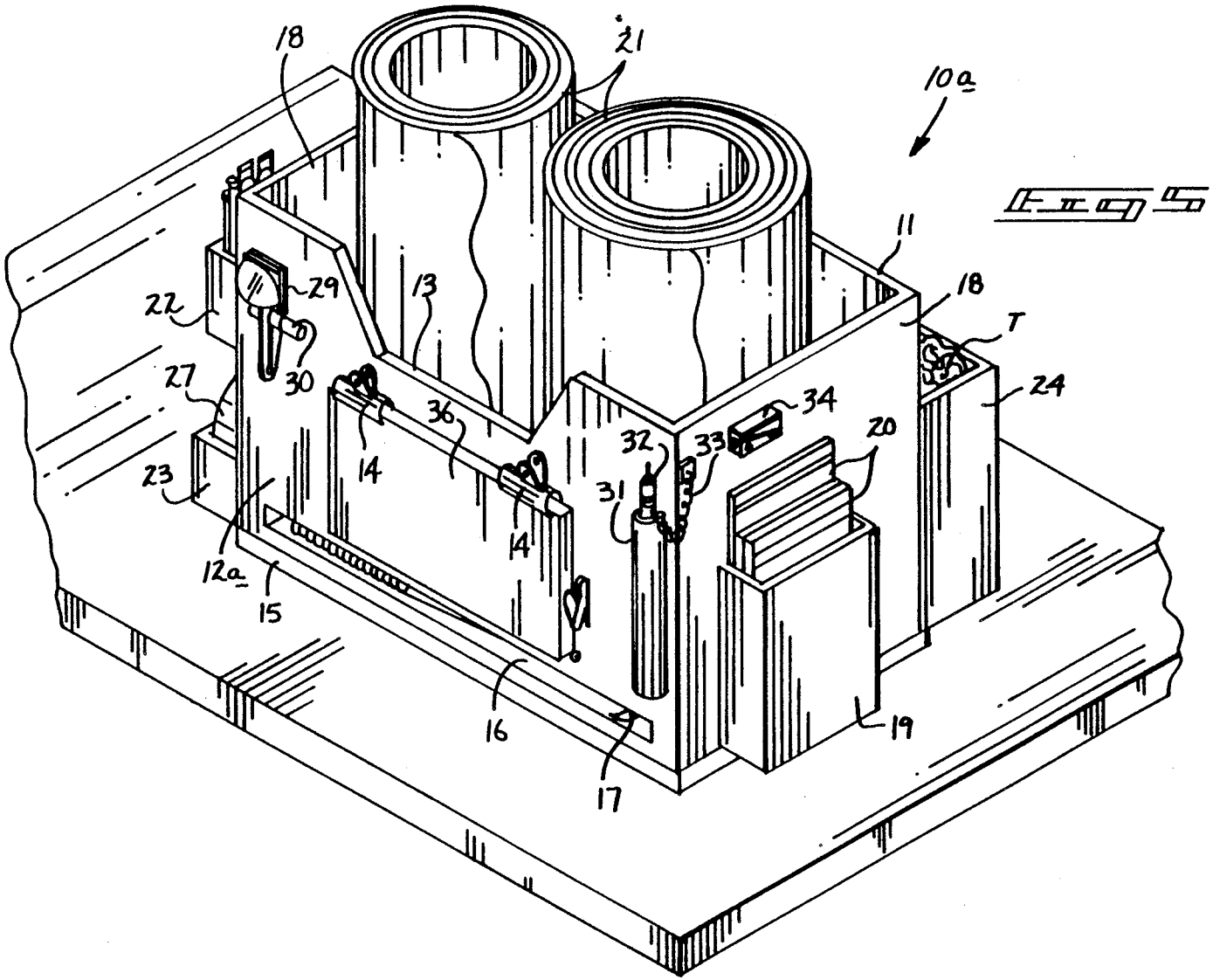
FIG. 5 is an isometric illustration of a modification of the instant invention.
Figure 6:
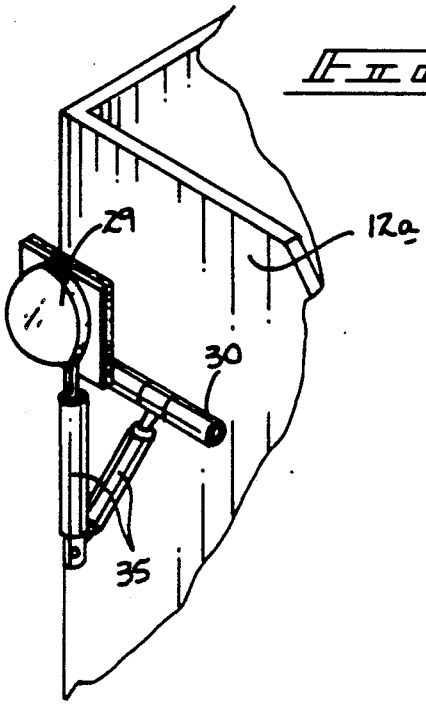
FIG. 6 is an isometric sectional illustration of an illumination member utilized by the instant invention.
Figure 7:
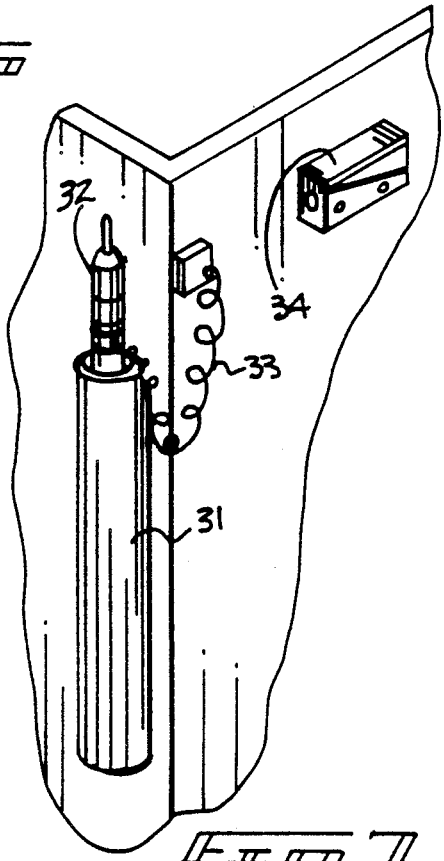
FIG. 7 is an isometric sectional illustration of a writing instrument mounted upon a forward wall of the modification of the instant invention.
Figure 8:
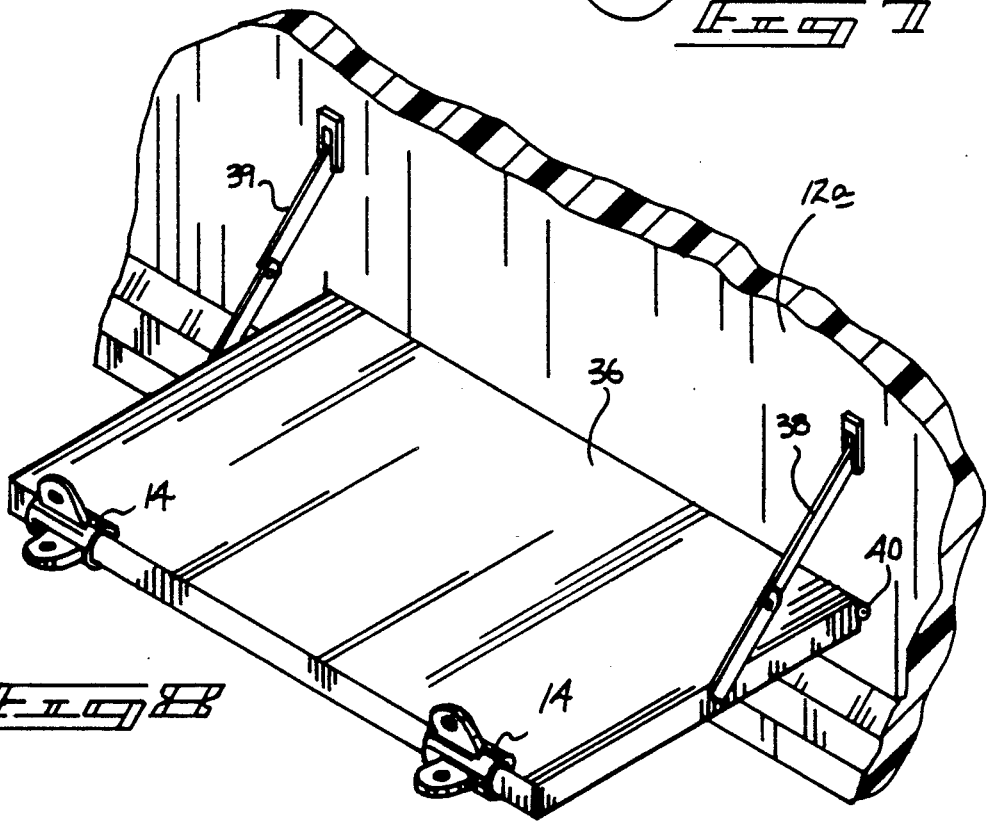
FIG. 8 is a sectional isometric illustration of the writing table utilized in the modification of the instant invention.

FIG. 5 illustrates the use of a modified apparatus 10*a*, wherein the forward modified wall 12*a* includes an illumination member 29. The illumination member 29 (see FIG. 6) is mounted to the modified forward wall 12*a* utilizing a support axle 30 to permit pivotment of a plurality of light pivoted linkages 35 to effect angulation and positioning of the illumination member 29, as required. The illumination member is positioned proximate a pivoted table 36 that is mounted hingedly to the modified forward wall underlying the "U" shaped recess 13. The table 36 includes a pivotal axle 40 mounting the table to the modified forward wall 12*a*, and includes a plurality of spaced linkages, including a first and second link arm assembly 38 and 39 respectively mounting side portions of the table 36 to the modified forward wall 12*a*. Further mounted adjacent the table 36 is a tubular socket 31, including a writing instrument 32 housed therewithin. The writing instrument 32 includes an accordion tether line 33 anchored to an adjacent side wall 18 to secure the writing instrument 32. The writing instrument is also positioned adjacent a pencil sharpener 34 to effect sharpening of the writing instrument 32, as required.

Accordingly, the container of the instant invention defines a central compartment 37 permitting convenient access to the shrink wrapper foil cylinders 21 mounted therewithin and provides the accessory components necesssary in effecting a wrapping and processing of various components for distribution to individuals.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and described to be protected by Letters Patent of the United States is as follows:

1. An order fill and supply container apparatus comprising, in combination, a container including a rear wall, a forward wall, and spaced side walls, the walls of a substantially equal predetermined height, with the forward wall including a "U" shaped access effecting access interiorly of a central compartment defined within a container defined by the rear wall, forward wall, and spaced side walls, and the central compartment including at least one shrink-wrap foil cylinder contained therewithin, wherein the cylinder includes a continuous sheet of foil for wrapping of various components, and the forward wall includes a plurality of spring clips, and an elongate slot recess formed through the forward wall, the slot recess substantially coextensive with the forward wall adjacent a lower terminal edge of the forward wall, and a floor of the container including a magnetic base.

2. An apparatus as set forth in claim 1 including a first compartment mounted on a first side wall, wherein the first compartment includes a plurality of note pads mounted therewithin, and a further side wall including a second compartment and a third compartment, the second compartment mounted overlying and coextensive with the further side wall overlying a third compartment underlying the second compartment and coextensive with the further side wall, the second compartment including a plurality of marker pens and pencils contained therewithin, and the third compartment including a plurality of wrapping tape members container within the third compartment, and a plurality of cutter members contained within the third compartment for selective cutting of wrapping tape from each wrapping tape member and for serving of foil from each foil cylinder.

3. An apparatus as set forth in claim 2 wherein the rear wall includes a fourth compartment, the fourth compartment substantially coextensive with the rear wall and integrally mounted thereto for reception of discarded debris therewithin.

4. An apparatus as set forth in claim 3 wherein the forward wall includes a pivoted table mounted pivotally to the forward wall, the pivoted table including an elongate pivot axle securing the table to the forward wall, and the spring clips mounted to the table for securement of various components mounted on the table when the table is in an extended configuration, and the table including a first and second link arm assembly, wherein the first and second link arm assembly are mounted to respective first and second side edges of the table to secure the table to the forward wall.

5. An apparatus as set forth in claim 4 including an illumination member pivotally and extensively mounted to the forward wall, the illumination member including an illumination member pivoted linkage, and wherein the pivoted linkage is mounted to a port axle to pivotally mount the pivoted linkage and the illumination member to the forward wall.

6. An apparatus as set forth in claim 5 including an elongate tubular socket, the tubular socket mounted to the forward wall and including a writing instrument mounted within the tubular socket, the writing instrument including an accordion tether line mounted to the writing instrument and the first side wall, and a pencil sharpener mounted to the first side wall spaced above the first compartment.

* * * * *